US010622766B2

(12) United States Patent
Droesbeke et al.

(10) Patent No.: US 10,622,766 B2
(45) Date of Patent: Apr. 14, 2020

(54) ELECTRICAL SHIELDING MEMBER FOR A NETWORK CONNECTOR

(71) Applicant: Aptiv Technologies Limited, St. Michael (BB)

(72) Inventors: Gert Droesbeke, Erkrath (DE); Matthew Antil, New Middletown, OH (US); Valery Volkov, Bochum (DE); Cory R. Ensley, Canfield, OH (US)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/363,210

(22) Filed: Mar. 25, 2019

(65) Prior Publication Data

US 2019/0334290 A1 Oct. 31, 2019

Related U.S. Application Data

(60) Provisional application No. 62/662,420, filed on Apr. 25, 2018.

(30) Foreign Application Priority Data

May 4, 2018 (EP) ..... 18170752

(51) Int. Cl.

| | |
|---|---|
| ***H01R 13/6583*** | (2011.01) |
| ***H01R 12/70*** | (2011.01) |
| ***H01R 13/629*** | (2006.01) |

(52) U.S. Cl.

CPC ..... *H01R 13/6583* (2013.01); *H01R 12/7005* (2013.01); *H01R 13/629* (2013.01); *H01R 2201/26* (2013.01)

(58) Field of Classification Search

CPC ..... H01R 13/6583; H01R 13/629; H01R 12/7005; H01R 2201/26

See application file for complete search history.

(56) References Cited

U.S. PATENT DOCUMENTS 7,588,461 B2 * 9/2009 Tyler ..... B60L 3/0069 439/607.41

FOREIGN PATENT DOCUMENTS

| | | | | |
|---|---|---|---|---|
| DE | 102015226034 | A1 | | 6/2016 |
| EP | 2884592 | A1 | | 6/2015 |
| EP | 3107155 | A1 | | 12/2016 |
| JP | 2019003939 | A | * | 1/2019 |
| WO | 2008109109 | A1 | | 9/2008 |
| WO | 2014108197 | A1 | | 7/2014 |

* cited by examiner

*Primary Examiner* — Abdullah A Riyami
*Assistant Examiner* — Nader J Alhawamdeh
(74) *Attorney, Agent, or Firm* — Robert J. Myers

(57) ABSTRACT

The present invention relates to an electrical shielding member for an electrical connector assembly. The electrical shielding member is made from bend and cut sheet metal. The electrical shielding member is configured to be received at least partially within a collector housing of an electrical connector assembly. The electrical shielding member comprises a receiving portion that is configured to receive a connector module and a corresponding connector module at least partially, so as to surround a mating region of the connector module and corresponding connector module on at least four sides.

16 Claims, 8 Drawing Sheets

10

ELECTRICAL SHIELDING MEMBER FOR A NETWORK CONNECTOR

CROSS-REFERENCE TO RELATED APPLICATION

This application claims the benefit under 35 U.S.C. § 119(e) of U.S. Provisional Patent Application No. 62/662,420 filed on Apr. 25, 2018 and further claims the benefit under 35 U.S.C. § 119(a) of Patent Application No. 18170752.2 filed in the European Patent Office on May 4, 2018, the entire disclosure of each of which is hereby incorporated by reference.

TECHNICAL FIELD OF THE INVENTION

The present invention relates to an electrical shielding member for an electrical connector assembly, an electrical connector assembly, and an electrical connector system as well as to a method to assemble the electrical connector assembly.

BACKGROUND OF THE INVENTION

In recent years, vehicles have been equipped with numerous on-board electronics. These on-board electronics provide a wide field of functionality, such as sensors, control functions and the like. These on-board electronics provide typical consumer electronic functions, navigation control and/or safety features, as well as e.g. feedback control for autonomous driving. For data communication between single on-board electronic components, data networks have been established within vehicles. These data networks communicate at high data rates, to allow for a safe and reliable communication. Typically, data networks are based on Ethernet networks, operating at data rates up to 100 Mbits/s and/or 1 Gbit/s.

With providing new kinds of on-board electronics, the need for higher data rates increases. However, the higher the data rate, the higher is the cross-talk level between single branches of the network, particularly if connectors and/or cables of these branches are arranged adjacent and/or substantially parallel to each other. This is typically the case, if a cable harness is used for wiring the vehicle. Further, a parallel orientation of multiple connectors and/or cables appears, where multiple data lines meet, e.g. in the vicinity of a control device and/or at a mating interface of such a control device.

Further, with increased data rates, the EMC (electromagnetic compatibility) properties of connectors decreases. Thus, typically, different connectors are provided for 100 Mbit/s networks and 1 Gbit/s networks. To overcome increased cross-talk levels and reduced EMC properties at data rates up to 1 Gbit/s, shielding members are typically provided in a housing of a network connector or the network connector system, to prevent radiation from entering and/or leaving the connector housing. However, known shielding members lead to large and bulky connectors. This is undesirable as the installation space is limited, especially in vehicles.

Further, the known housings that cover a shielding member are typically multi-part housings, that are configured to house the shielding member. These multi-part housings are prone to damages as single parts can get lost, if not assembled correctly. Further, assembling multi-part housings is time and cost inefficient.

Therefore, there is a need in the art to provide an electrical shielding member for an electrical connector assembly, an electrical connector assembly and electrical connector system that overcome the above-mentioned drawbacks.

SUMMARY OF THE INVENTION

According to one embodiment of the invention, an electrical shielding member for an electrical Ethernet connector assembly is provided. The electrical shielding member is made from bent and cut sheet metal, and is configured to be received at least partially within a collector housing of an electrical connector assembly. The electrical shielding member comprises a receiving portion, that is configured to receive a connector module and/or a corresponding connector module at least partially, so as to surround a mating region of the connector module and the corresponding connector module on at least four sides, when the electrical connector assembly is mated with a second electrical connector assembly.

Forming the electrical shielding member from bend and cut sheet metal allows to provide cost efficient shielding members. In particular, the precut sheet metal can be supplied to an assembly line in a substantially flat condition and can be bend to its final shape during the assembly of the electrical connector assembly. Thus, the risk of damaging the electrical shielding member during transport and storage is reduced and the electrical shielding member can be configured to the geometry of the receiving collector housing during the assembly procedure. This allows for wider manufacturing tolerances. The sheet metal may have a material thickness of 0.15 to 0.5 mm, preferably from 0.2 to 0.4 mm and most preferably of 0.3 mm.

The receiving portion is the portion of the electrical shielding member that receive a connector module of an electrical connector assembly when the electrical shielding member is in an assembled state. Further, the receiving portion may receive a corresponding connector module when the electrical connector assembly is mated with a corresponding electrical counter connector assembly. Thus, the electrical shielding member, and in particular the receiving portion of the electrical shielding member provides the electrical shielding for the mating region. The mating region is a region, where a signal contact of the electrical connector assembly electrically contacts with a corresponding signal contact of a corresponding electrical counter connector assembly connector. A signal contact and/or corresponding signal contact may be provided in form of an electrical contact pin, an electrical contact terminal, an electrical contact beam, or the like.

An electrical connector assembly may comprise a connector module, which in turn comprises electrical signal contacts. The electrical signal contacts define the location of the mating region. The electrical shielding member covers the mating region on at least for sides and thus provides a proper shielding in this region. Thus, communicating with data rates of at least 100 Mbits/sec and preferably of at least 1 Gbit/sec is possible. The four-side shielding, provided by the electrical shielding member can dampen cross talk between adjacent electrical connector assemblies that are provided with the above described electrical shielding member of up to 60 dB at 200 MHz, preferably up to 70 dB at 200 MHz and most preferably up to 80 dB at 200 MHz. Thus, cross talk can be significantly reduced. Further, the four-sided shielding reduces external noise and allows to maintain the signal integrity, of the signal that is transmitted by the electrical connector assembly.

The electrical shielding member may further comprise at least one primary guiding element that protrudes inwardly into the receiving portion and is configured to guide and to support the connector module and/or the corresponding connector module, when the respective connector module is received within the receiving portion.

The guiding element guides the connector module and/or the corresponding connector module, when the respective connector module is received within the receiving portion. Particularly, the guiding element can guide a connector module of an electrical connector assembly during assembly of the same, and/or the guiding element can guide a corresponding connector module of a corresponding electrical counter connector assembly during mating the electrical connector assembly with the corresponding electrical counter connector assembly. This allows for a reliable manufacturing of the connector module and mating with the corresponding connector module. Further, the guided connector module/corresponding connector module is supported by the guiding element of the electrical shielding member, in the assembled state. Thus, the electrical connector assembly and/or the mated electrical connector system, comprising an electrical connector assembly and a corresponding electrical counter connector assembly is less prone to damages or disconnection, e.g. due to vibration or external shocks. Those vibrations or shocks are typical in vehicles. This leads to a reliable electrical connection between the electrical connector assembly and the corresponding electrical counter connector assembly.

Still further, the electrical shielding member may comprise, a locking element that is configured to lock with a corresponding locking element of the collector housing, when the electrical shielding member is in an assembled state.

A collector housing is a housing of the electrical connector assembly, that houses a connector module at least partially. The locking element allows to easily assemble the electrical shielding member within the collector housing. For example, the electrical shielding member, comprising the locking element, can be inserted into a receiving opening of the collector housing and lock with the corresponding locking element by means of the locking element. Thereby, the electrical shielding member is secured within the collector housing. Particularly, the locking element can be configured to secure the electrical shielding member against rotational and/or axial displacement. This allows to provide a one-piece collector housing, and to insert the electrical shielding member from a receiving opening into the collector housing. In particular, it is not required to provide a multi-part collector housing that houses the shielding member entirely. Thus, the dimensions of the collector housing can be reduced and the overall size of the electrical connector assembly can be minimized.

The receiving portion may have a substantially rectangular cross-section, seen from a mating direction. Providing a substantially rectangular cross section allows for a simplified bending of the electrical shielding member, thereby providing a very cost efficient electrical shielding member, having excellent shielding properties. Further, the rectangular cross section allows to orient the electrical shielding member relative to the collector housing in a defined way and protect the electrical shielding member from rotational displacement.

The electrical shielding member may further comprise at least one secondary guiding element that protrudes inwardly into the receiving portion, wherein the secondary guiding element is configured to guide and to support the connector module and/or a corresponding connector module, when the respective connector module is received within the receiving portion, and wherein the at least one primary guiding element protrudes from a first side inwardly into the receiving portion and wherein the at least one secondary guiding element preferably protrudes from an opposing side inwardly into the receiving portion.

The secondary guiding element provides a further guiding and support of the connector module and/or the corresponding connector module. Particularly, the secondary guiding element can guide a connector module of an electrical connector assembly during assembly of the same, and/or the secondary guiding element can guide a corresponding connector module of a corresponding electrical counter connector assembly during mating the electrical connector assembly with the corresponding electrical counter connector assembly. This allows for a reliable manufacturing of the connector module and mating with the corresponding connector module. Still further, the first and secondary guiding elements may be arranged so that the first guiding element guides and supports the connector module and the second guiding element guides and supports the corresponding connector module, or vice versa. Alternatively, first and secondary guiding elements may guide and support the connector module or the corresponding connector module. Thus, an even more reliable electrical connector assembly or system can be provided that is less prone to vibration and/or shocks.

The secondary guiding element can be arranged so that it protrudes from an opposing side with respect to the first guiding element inwardly into the receiving portion. Thereby, the received (corresponding) connector module can be guided and supported from two opposing sides. This allows to further secure the (corresponding) connector module within the receiving portion. Further, there can be provided a preloading for the (corresponding) connector module by means of the first and second guiding elements, to increase the shock and vibration resistance of the connector assembly/system.

The primary guiding element and/or the secondary guiding element may be formed as an embossed element. Providing the guiding elements as embossed elements, allows for a cost-effective manufacturing. Further, embossing allows to selectively configur the protruding depth of the guiding elements into the receiving portion and therefore to configur a preload force that may be applied via the first and/or second guiding elements onto the received connector module.

The locking element can be a locking lance that protrudes inwardly into the receiving portion and may have a free end that is oriented towards a receiving opening of the electrical connector assembly, when the electrical shielding member is in an assembled state. Providing a locking lance having a free end, allows to fixedly secure the electrical shielding member within the collector housing. In particular, the locking lance can snap into a corresponding locking element, which can be provided as a locking recess. This allows for a secure fastening of the electrical shielding member within the collector housing. In particular, the retention force of the electrical shielding member from the collector housing can be provided significantly higher than a retention force of the connector module from the collector housing. For example, a retention force of the electrical shielding member of at least 40 N, preferably of at least 50 N and most preferably of at least 60 N can be achieved.

The electrical shielding member may further comprise a first coupling element that protrudes outwardly from the receiving portion, wherein the first coupling element may be configured to couple with a corresponding coupling element of the collector housing, when the electrical shielding member is in an assembled state, so as to allow the electrical shielding member to be assembled only under a predefined orientation. The coupling element facilitates the assembly of the electrical shielding member within the collector housing as the coupling element allows an assembly only under a predefined orientation/rotation of the electrical shielding member. Thus, it can be ensured that e.g. the locking element is oriented correctly and locks with the corresponding locking element of the collector housing, when being assembled. Therefore, the risk for damages can be significantly reduced and a more reliable manufacturing can be provided. The corresponding coupling element of the collector housing may be provided as a coupling recess that receives the protruding coupling element of the electrical shielding member.

The electrical shielding member may further comprise a second coupling element that is arranged in proximity to a front end of the receiving portion, wherein the front-end faces towards a receiving opening of the electrical connector assembly, when the electrical shielding member is in an assembled state. The second coupling element may be configured to couple with a corresponding coupling element of a second collector housing, when the electrical shielding member is in an assembled state and when the electrical connector assembly is mated with a second electrical connector assembly.

The second collector housing is a collector housing of the corresponding electrical counter connector assembly. The second coupling element allows for a facilitated mating of the electrical connector assembly with a corresponding electrical counter connector assembly. This is, as the second coupling element may engage with a corresponding coupling element of the second collector housing and thereby guiding the electrical connector assembly and the corresponding electrical counter connector assembly in a mating orientation relative to each other. Further, after mating, the corresponding electrical counter connector assembly and the electrical connector assembly the electrical shielding member can be further secured by the second coupling element.

The receiving portion may comprise opposing joint rims, wherein a first joint rim is provided with a locking contour and the second joint rim is provided with a corresponding locking contour, and wherein the locking contour engages with the corresponding locking contour, when the electrical shielding member is bent to its final shape. Providing locking contours on opposing joint rims allows to provide a mechanically stable electrical shielding member.

According to another embodiment of the invention, an electrical connector assembly is provided. The electrical connector assembly may be a network connector assembly that is preferably capable of communicating at data rates of at least 100 Mbit/s and/or at least 1 Gbit/s.

These data rates allow for a fast and reliable communication between a single component, such as an on-board electronic component. Thus, new applications, such as autonomous driving can be established.

The electrical connector assembly comprises an electrical shielding member as described above, and a connector module, wherein the connector module comprises electrical contact pins and/or electrical contact terminals. The electrical connector assembly further comprises a collector housing, wherein the collector housing houses the connector module and is configured to receive a corresponding connector module at least partially, when the electrical connector assembly is mated with a second electrical connector assembly (i.e. a corresponding electrical counter connector assembly) that comprises the corresponding connector module.

The electrical shielding member allows for a properly shielded electrical connector assembly that may reduce external noise, measured at 200 MHz of about 60 dB, preferably of at least 70 dB and most preferably of at least 80 dB. Further, the signal integrity of the signals, being transmitted with the respective electrical connector assembly can be maintained.

The collector housing may comprise a corresponding locking element, that locks with the locking element of the electrical shielding member and secures the electrical shielding member within the collector housing. As described above, the locking element and the corresponding locking element allow for a facilitated assembly of the electrical shielding member within the collector housing. Thereby, the electrical connector housing can be provided as a one-piece electrical connector housing. This allows to reduce the size of the electrical connector assembly.

Further, the electrical shielding member is arranged within the collector housing to be in electrical contact with a shielding of the connector module and a shielding of the corresponding connector module, when the electrical connector assembly is mated with a second electrical connector assembly (i.e. a corresponding electrical counter connector assembly).

Arranging the electrical shielding member within the collector housing so as to be in contact with a shielding of the connector module and a shielding of a corresponding connector module allows for a continuous inline shielding of the electrical signal lines of the respective connector modules, not only in the mating region. Thus, a significant improvement of the shielding can be achieved.

Still further, the collector housing may comprise a corresponding coupling element that couples with the coupling element of the electrical shielding member and secures the electrical shielding member in a predefined orientation. The coupling element allows for a correct assembly of the electrical connector assembly, as the electrical shielding member can be inserted in the collector housing only under one predefined orientation. Thus, damages due to incorrect assembly can be prevented.

Further, the collector housing may be a one-piece collector housing. A one-piece collector housing may be an injection molded plastic part, a 3D printed part, an extruded part or any other part, being provided with suitable manufacturing techniques. In particular, the one-piece collector housing may comprise a plastic material or a compound plastic material. Providing a one-piece collector housing allows for a compact design and therefore for an overall compact size of the electrical connector assembly.

The electrical shielding member may be arranged within the collector housing so that it surrounds a mating region of the connector module and a corresponding connector module on at least four sides, when the electrical connector assembly is mated with a second electrical connector assembly. Providing a four-side shield allows for a significantly improved electrical shielding, as described above and therefore for increased data rates.

The electrical shielding member and the connector module may be arranged within the collector housing so that during mating the electrical connector assembly with a second electrical connector assembly (i.e. a corresponding electrical counter connector assembly), the electrical shielding member comes into electrical contact with a shielding of the corresponding connector module, before the electrical contact pins and/or terminals of the connector module come into electrical contact with corresponding electrical contact terminals and/or pins of the corresponding connector module.

If the electrical shielding member at first contacts with a respective shielding of a (corresponding) connector module, before the electrical signal contacts (terminals and/or pins) mate with each other, an ESD-protection can be provided. This is, as the grounding, i.e. the shielding come into electrical contact with each other and subsequently, the electrical signal lines are electrical connected. Thus, the electrical shielding member additionally allows for an improved ESD protection.

According to yet another embodiment of the invention, an electrical connector system is provided. The electrical connector system comprises an electrical connector assembly as described above, and a second electrical connector assembly (i.e. a corresponding electrical counter connector assembly), that is configured to be mated with the electrical connector assembly, wherein the second electrical connector assembly comprises a corresponding connector module that includes electrical contact terminals and/or electrical contact pins and a shielding.

The first electrical connector assembly may be a male connector assembly, comprising electrical contact pins, wherein the second electrical connector assembly (i.e. a corresponding electrical counter connector assembly) may be a female connector assembly, comprising electrical contact terminals for receiving the electrical contact pins.

The second electrical connector assembly of the electrical connector system may further comprise a second collector housing, that includes a corresponding coupling element that is configured to couple with the electrical shielding member, when the electrical connector assembly is mated with the second electrical connector assembly. The corresponding coupling element of the second collector housing allows for orienting the electrical contact assembly, comprising the electrical shielding member and the second electrical connector assembly during mating towards each other, so that the mating is facilitated. Further, the corresponding coupling element and the second coupling element, provide an additional fastening of the electrical connector assembly and the second electrical connector assembly, when being mated. Providing the second coupling element at the electrical shielding member, allows to provide an integral structure and therefore a small electrical connector assembly.

According to one more embodiment of the invention, a method to assemble an electrical connector assembly as described above is provided. The method comprises the steps of providing an electrical shielding member, as described above, providing a collector housing, providing a connector module, assembling the electrical shielding member and the collector housing and locking the locking element of the electrical shielding member with the corresponding locking element of the collector housing, and inserting a connector module at least partially into the receiving portion of the electrical shielding member, so that the electrical shielding member surrounds the mating region of the connector module on at least four sides.

With the above-described method, assembling an electrical connector assembly as described above becomes possible, wherein all advantages described above can be achieved.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1A:
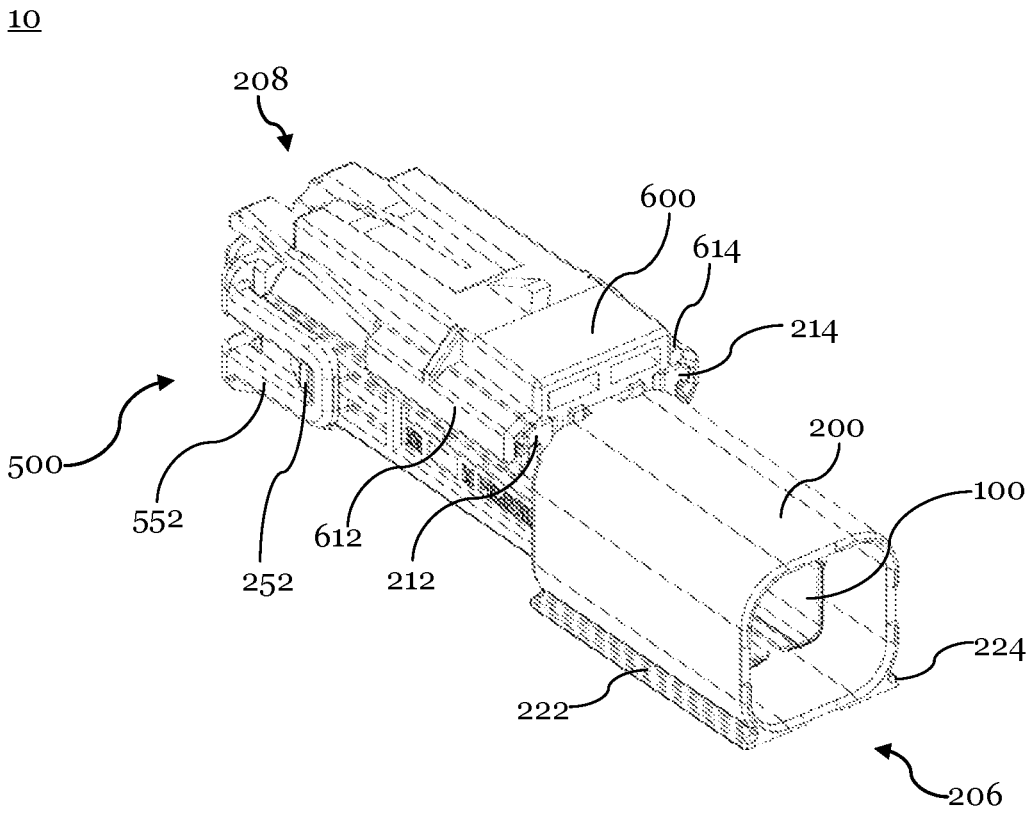
FIG. 1A is a schematic top view of an electrical connector assembly according to an embodiment of the invention.
Figure 1B:
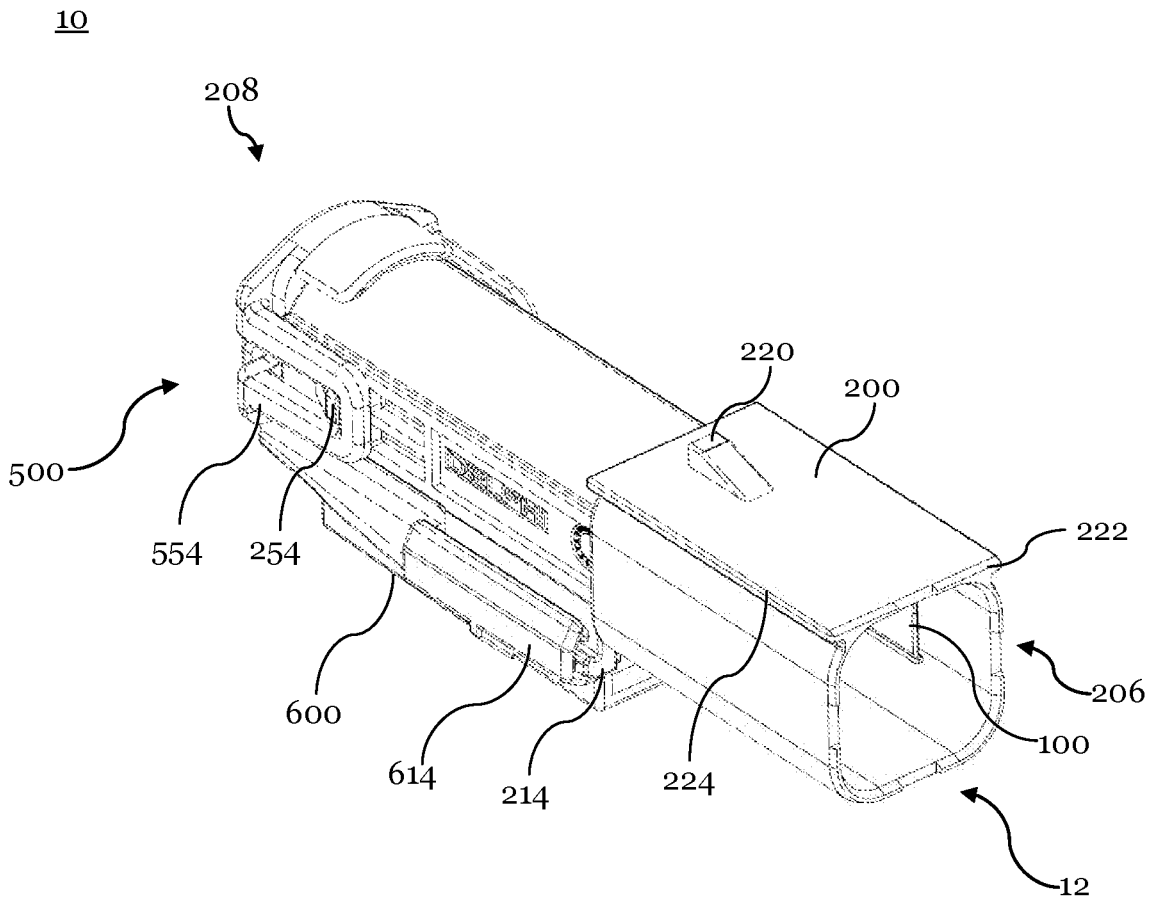
FIG. 1B is a schematic bottom view of the electrical connector assembly of FIG. 1A according to an embodiment of the invention.

FIG. 1A shows a schematic top view of an electrical connector assembly 10 and FIG. 1B shows a schematic bottom view of the electrical connector assembly 10 of FIG. 1A. The electrical connector assembly 10 is a male electrical connector assembly that may comprise electrical signal contacts in form of electrical signal pins (not shown). The electrical connector assembly 10 comprises an electrical shielding member 100, which is described in greater detail with reference to FIGS. 3A and 3B.

The electrical shielding member 100 is received within the collector housing 200, which may be a male collector housing. The male collector housing 200 further houses a connector module (not shown) that comprises electrical signal contacts that are electrically connected to wires of cable (not shown).

The electrical connector assembly 10 comprises a receiving opening 12, for at least partially receiving a corresponding connector assembly. The receiving opening 12 is provided at a front end 206 of the male collector housing 200.

Further, the electrical connector assembly 10 comprises a retaining member 500 and a fastening member 600. The fastening member 600 is configured to be slid onto the collector housing 200, respectively on first guiding rails 212, 214. The fastening member 600 is provided with corresponding guiding recesses 612, 614 that are configured to engage with the first guiding rails 212, 214.

The retaining member 500 is configured to be latched to the collector housing 200 by means of latching arms 552, 554 that latch with corresponding latching noses 252, 254, provided laterally on the collector housing 200. The retaining member 500 is coupled on a rear end 208 of the male collector housing 200 to the male collector housing 200.

Figure 6:
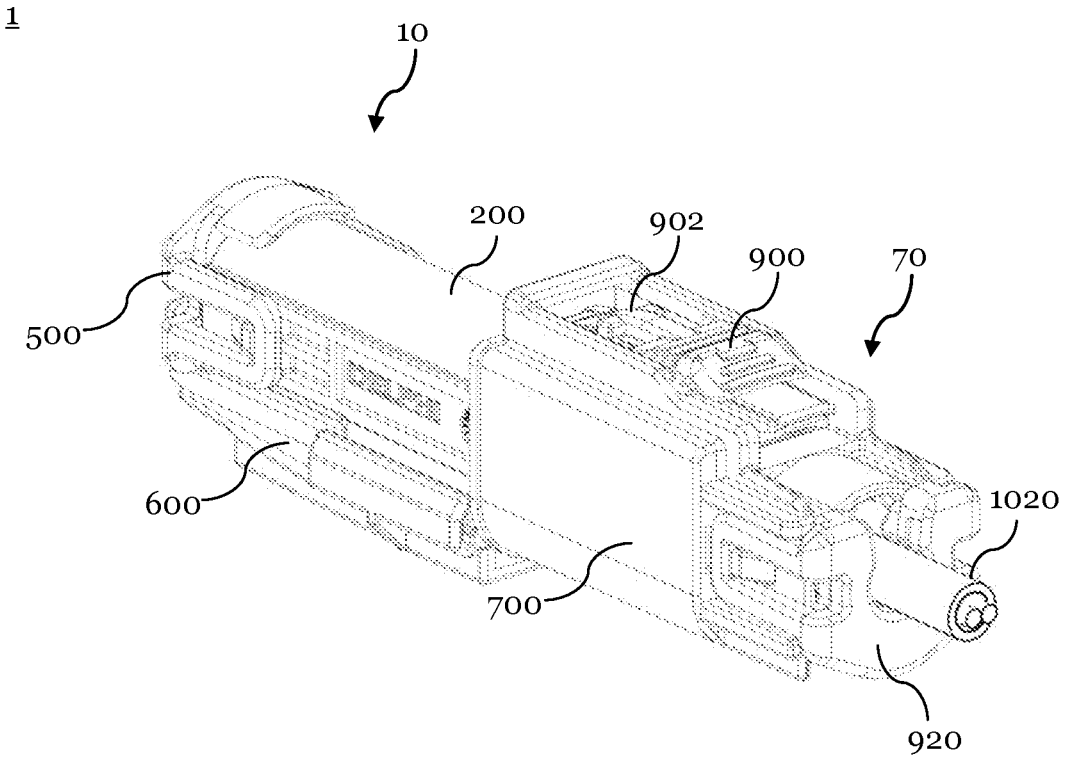
FIG. 6 is a schematic view of the electrical connector system of FIG. 5, in a mated condition according to an embodiment of the invention.

The collector housing 200 is provided with second guiding rails 222, 224 that are configured to engage with corresponding guiding recesses of a second (female) collector housing 700, as shown in FIG. 6. The collector housing 200 comprises a corresponding primary latching element 220, which will be described in greater detail with respect to FIG. 7.

Figure 2:
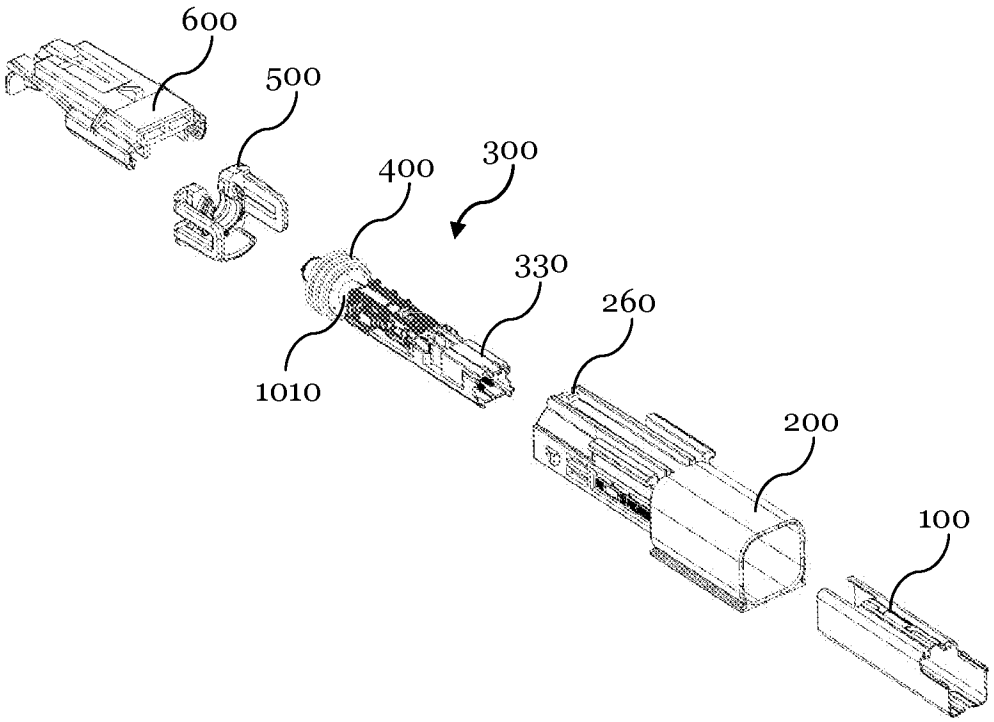
FIG. 2 is a schematic exploded view of the electrical connector assembly of FIGS. 1A and 1B according to an embodiment of the invention.

FIG. 2 shows the electrical connector assembly 10 of FIGS. 1A and 1B in an exploded view. The electrical connector assembly 10 comprises an electrical shielding member 100 and a collector housing 200, having a locking nose 260, which will be described in greater detail with respect to FIG. 7. The electrical connector assembly 10 further comprises a male connector module 300. The male connector module 300 comprises a connector module housing 330 that houses electrical signal contacts, such as electrical contact pins 312, 314. The electrical connector assembly 10 is provided with a sealing member 400, to seal the electrical connector assembly 10 against moisture, dust and the like. Thus, the electrical connector assembly 10 can be used in rough environments, e.g. within an engine compartment of a vehicle.

Further, the electrical connector assembly comprises a retaining member 500 and a fastening member 600 as described above. During assembly, the electrical shielding member 100 is first inserted into the collector housing 200 and locked thereto by means of the locking element 110. Subsequently, an electrical connector module 300 is inserted and secured by means of the retainer 500. These assembly steps can also be performed in a different order. Additionally, a fastening member 600 can be applied.

Figure 3A:
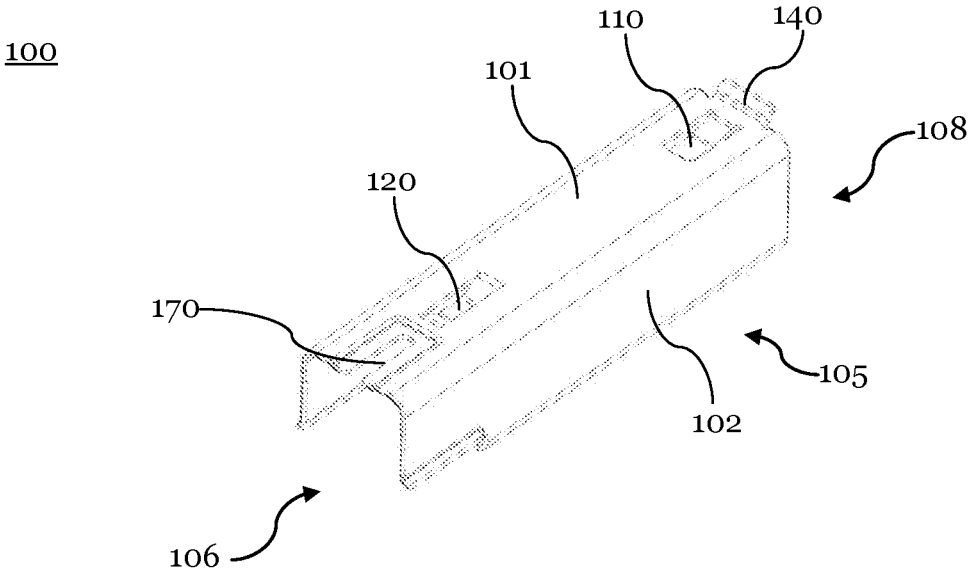
FIG. 3A is a schematic bottom view of an electrical shielding member according to an embodiment of the invention.
Figure 3B:
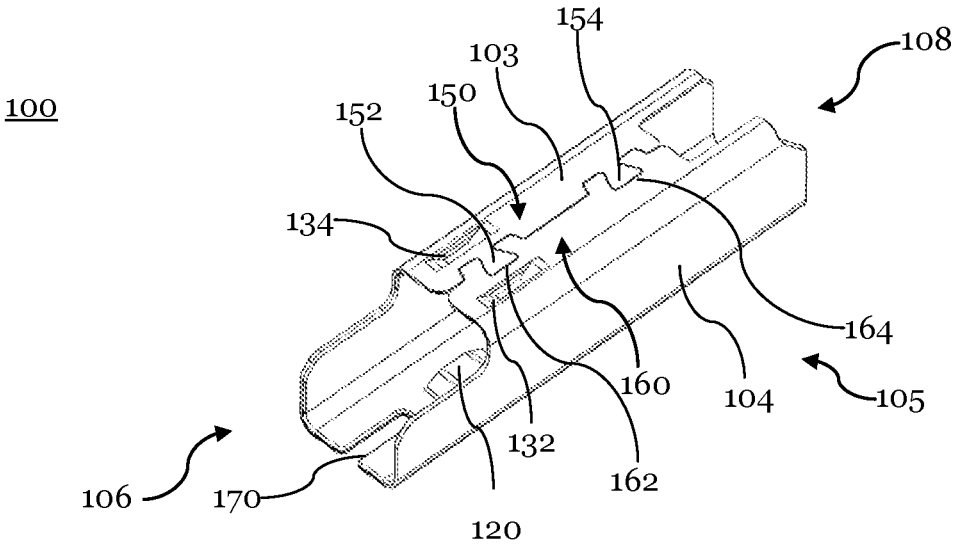
FIG. 3B is a schematic top view of the electrical shielding member of FIG. 3A according to an embodiment of the invention.

FIG. 3A shows a schematic detailed view of the electrical shielding member 100, seen from a bottom side and FIG. 3B shows a schematic top view of the electrical shielding member 100 of FIG. 3A. The electrical shielding member 100 has a substantially square cross section, when seen from a mating direction. The electrical shielding member 100 may have a height of 6 to 12 mm, a width of 5 to 11 mm and/or a length of 28 to 38 mm. Preferably, the electrical shielding member 100 may have a height of 8 to 10 mm, a width of 7 to 9 mm and/or a length of 30 to 35 mm. Accordingly, the electrical shielding member is provided with first, second, third and fourth sides 101, 102, 103, 104. The first side 101 corresponds to the bottom side of the electrical shielding member 100 and the third side 103 corresponds to the top side of the electrical shielding member 100.

On the first side 101, a locking element 110 is provided in form of an embossed locking lance 110, having a free end that protrudes inwardly into a receiving portion 105 and is oriented toward a receiving opening 12 of the electrical connector assembly 10, when the electrical shielding member 100 is an assembled state. In this embodiment, the free end of the locking lance 110 is oriented towards a front end 106 of the electrical shielding member 100. Further, a primary guiding element 120 is embossed in the first side 101 so that it protrudes inwardly into the receiving portion 105. The primary guiding element 120 is configured to guide and to support a (corresponding) connector module 300, 800, when the electrical connector assembly is assembled and/or mated with a second electrical connector assembly (i.e. a corresponding electrical counter connector assembly).

Further, a first coupling element 140 is provided on a rear end 108 of the electrical shielding member 100. The first coupling element 140 protrudes outwardly from the receiving portion and couples with a corresponding coupling element 240 of the collector housing 200, thereby allowing only one predefined orientation of the electrical shielding member 100 in an assembled state.

As further shown in FIG. 3B, the electrical shielding member 100 may comprise first and second secondary guiding elements 132, 134, which are embossed on the third side 103 of the electrical shielding member 100. Thus, the first and second secondary guiding elements 132, 134 are provided on an opposing side with respect to the first guiding element 120. Thus, a received (corresponding) connector module 300, 800 can be guided and supported from at least two sides and a preload force may be applied onto that received connector module 300, 800.

The electrical shielding member 100 is formed from cut and bent sheet metal, and comprises a locking contour 150 and a corresponding locking contour 160 at opposing joint rims. The locking contour comprises locking protrusions 152, 154, wherein the corresponding locking contour 160 comprises locking recesses 162, 164 which engage with each other, when the electrical shielding member 100 is in its final bent state. Thus, a mechanically stable electrical shielding member 100 can be provided.

Figure 4:
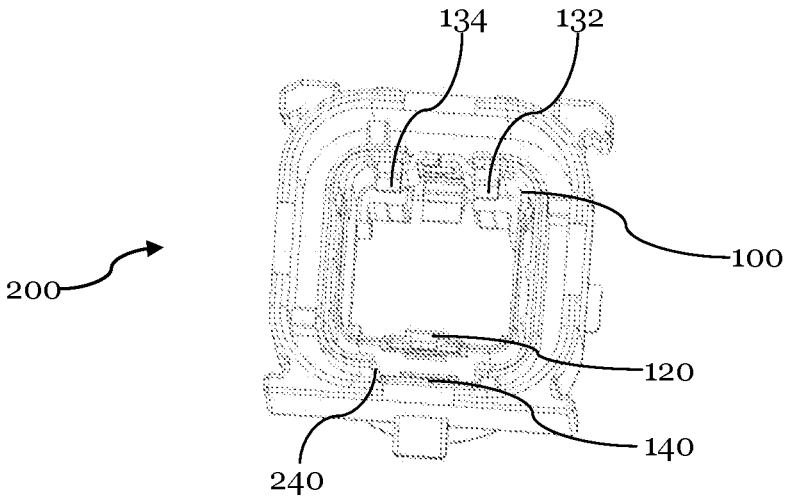
FIG. 4 is a schematic view of the electrical shielding member of FIGS. 3A and 3B, mounted in a male collector housing, seen from a front end according to an embodiment of the invention.

Further, at the front end 106 of the electrical shielding member 100 a second coupling element 170 may be provided, preferably in form of a slot. This slot allows to couple the electrical shielding member 100 with a corresponding second coupling element 770 of a second (female) collector housing 700, as for example shown in FIG. 7. FIG. 4 shows a collector housing 200 with an assembled electrical shielding member 100. A first primary guiding element 120 and first and second secondary guiding elements 132, 134 protrude inwardly into the receiving portion 105 of the electrical shielding member 100. Thereby allowing to support and guide a (corresponding) connector module 300, 800 within the receiving portion 105. Further, a first coupling element 140 is coupled to a respective corresponding coupling element 240 of the collector housing 200. Thereby, the electrical shielding member 100 can be assembled to the collector housing 200 only under a predefined orientation and is prevented from a rotational displacement.

Figure 5:
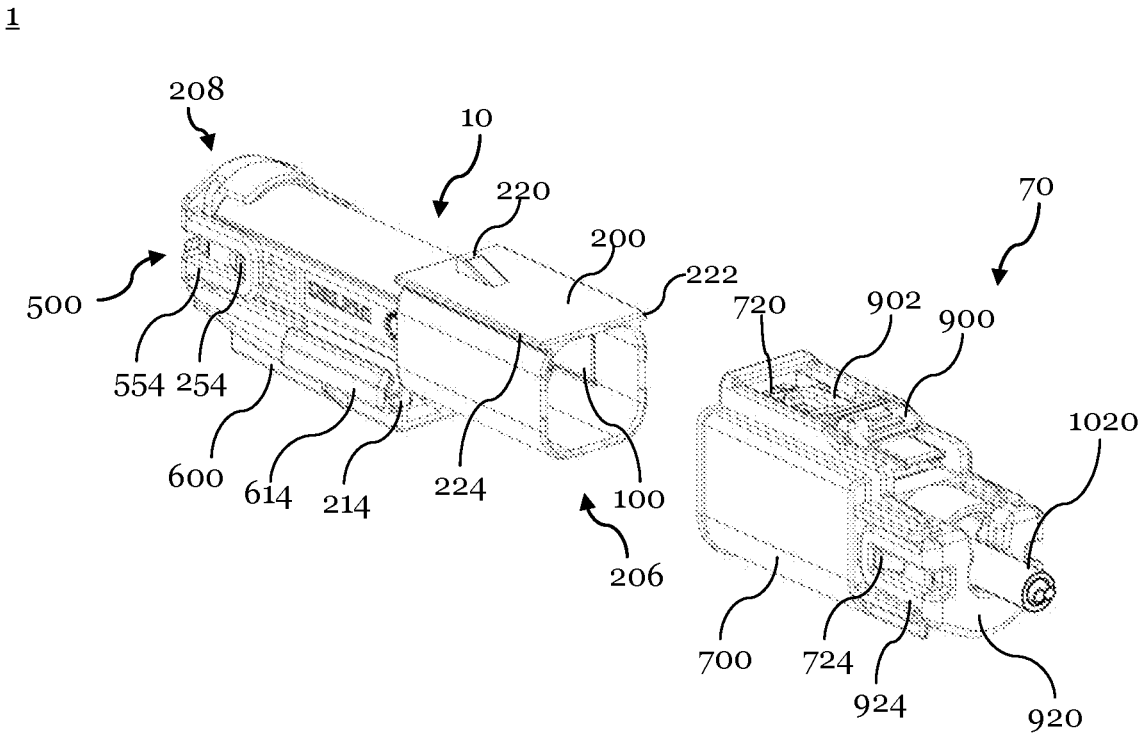
FIG. 5 is a schematic view of an electrical connector system, in an unmated condition according to an embodiment of the invention.

FIG. 5 shows an electrical connector system 1 in an unmated condition. The electrical connector system 1 comprises a male electrical connector assembly 10, as described with greater detail with respect to FIGS. 1A and 1B. The electrical connector system 1 further comprises a female electrical connector assembly (i.e. a corresponding electrical counter connector assembly) 70, which comprises a corresponding (female) connector module 800 (not shown) that is housed within a second (female) collector housing 700. By means of a latching nose 724, a retaining member 920 may be latched to the second (female) collector housing 700, having latching arms 924. A retainer 920 may secure the female connector module 800 (not shown) within the second collector housing 700.

Further, the female collector housing 700 may have a primary latching element 720 that is configured to latch with the corresponding primary latching element 220 of the male collector housing 200. The primary latching element 720 can be provided in form of a latching arm, wherein the corresponding primary latching element 220 can be provided as a latching nose. Primary latching element 720 and corresponding primary latching element 220 latch with each other, when the male electrical connector assembly 10 is mated with the female electrical connector assembly 70. Thereby, the male electrical connector assembly 10 and the female electrical connector assembly 70 are secured to each other. Further, a fastening member 900 may be provided that is equipped with a secondary latching arm 902 that couples with the latching nose 220 of the collector housing 200 and thereby provides an additional fastening.

Figure 7:
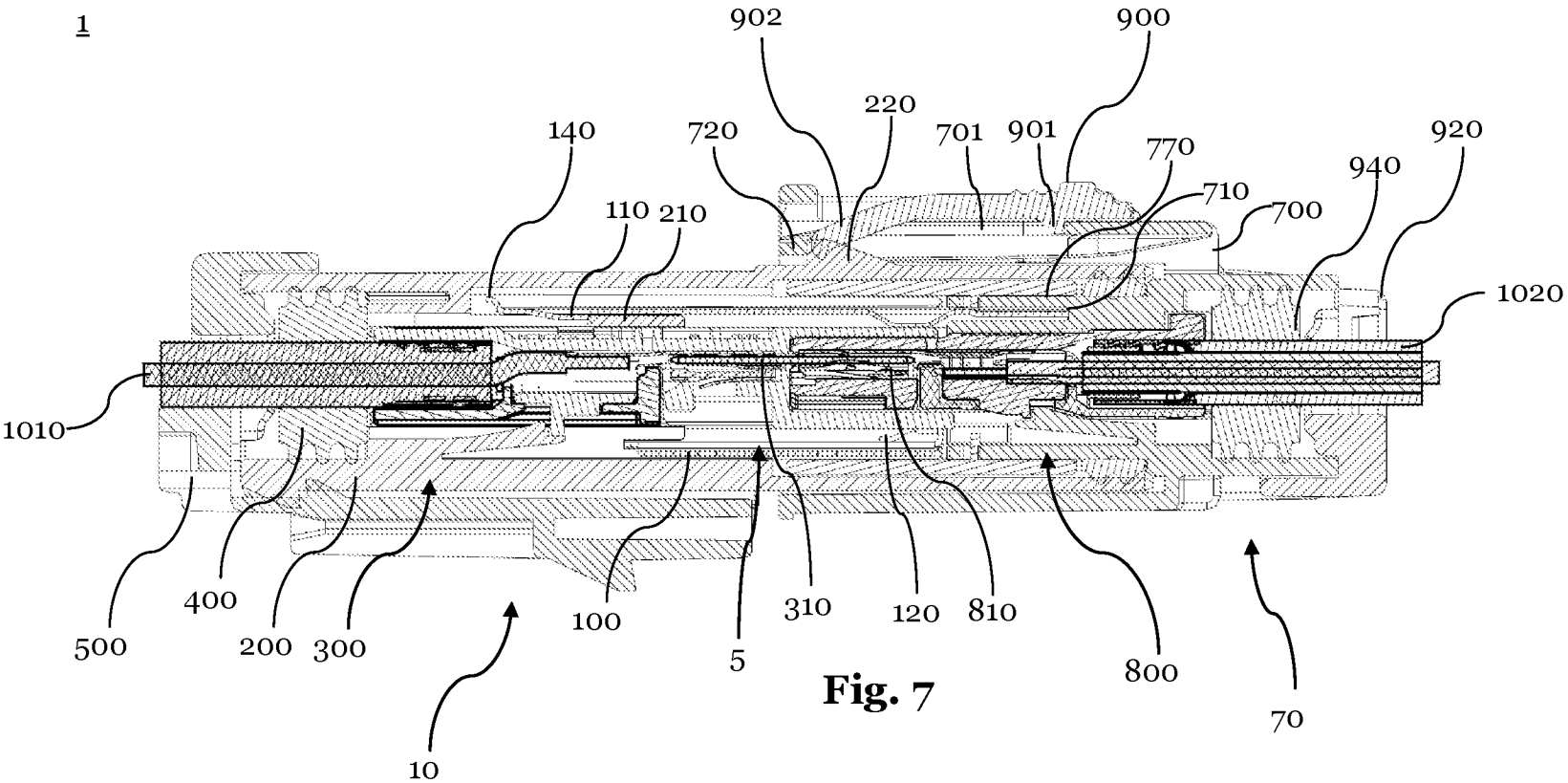
FIG. 7 is a schematic cut view of the electrical connector system of FIG. 6 according to an embodiment of the invention.

FIG. 6 shows the electrical connector system 1 of FIG. 5 in an assembled state and FIG. 7 shows the electrical connector system 1 of FIG. 6 in a longitudinally cut view. The electrical connector system 1 comprises a male electrical connector assembly 10 that can be mated with a female electrical connector assembly 70.

The male connector assembly 10 comprises an electrical shielding member 100, a collector housing 200, a male connector module 300, a sealing member 400, a retaining member 500 and a fastening member 600 (not shown). The male connector module 300 comprises male electrical contact pins 310, 312 that are configured to be mated with corresponding female electrical contact terminals 810, 812 of a female connector module 800. The region, where the electrical contact pins 310, 312 mate with the electrical contact terminals 810, 812 is the mating region 5.

The primary guiding element 120 supports the housing 330 of the male connector module 300 and prevents thereby the male connector module from being displaced, e.g. due to vibration or external shocks. The electrical contact pins 310, 312 of the male connector module 300 are electrically connected to wires 1012, 1014 of a first cable (not shown). The electrical contact terminals 810, 812 of the connector module 800 are connected to wires 1024, 1022 of a second cable 1020.

Further, the coupling element 140 is coupled to a corresponding coupling element 240 of the collector housing 200 and a locking element 110 is locked to a corresponding locking element 210.

The female electrical connector assembly 70 comprises a female collector housing 700, a female connector module 800, a fastening member 900, a retaining member 920 and a sealing member 940. The female connector module 800 comprises female electrical contact terminals 810, 812 that are in an electrical contact with the electrical contact pins 310, 312. Further, the retaining member 920 secures the sealing member 940 and the female connector module 800 within the collector housing 700. The collector housing 700 comprises a stopping element 710 in form of a recess that receives the electrical shielding member 100 at least partially. The front end 106 of the electrical shielding member 100 can abut with an end face of the recess 710, thereby limiting the maximum insertion depths of the male connector assembly 10 within the electrical connector assembly 70. Further, the second coupling element 170 of the electrical shielding member 100 can couple with a corresponding coupling element 770 of the female collector housing 700.

To fixedly mate the female electrical connector assembly 70 with the electrical connector assembly 10, the electrical connector assembly 70 is provided with a primary latching element 720 that latches with a corresponding primary latching element 220 of the collector housing 200. To provide a secondary latching, a fastening member 900 is provided that is coupled to the female collector housing 700 via a locking protrusion 901 and a corresponding locking recess 701. The fastening member 900 is provided with a secondary latching arm 902 that engages with the primary latching element 720 and/or the corresponding primary latching element 220, respectively.

Figure 8:
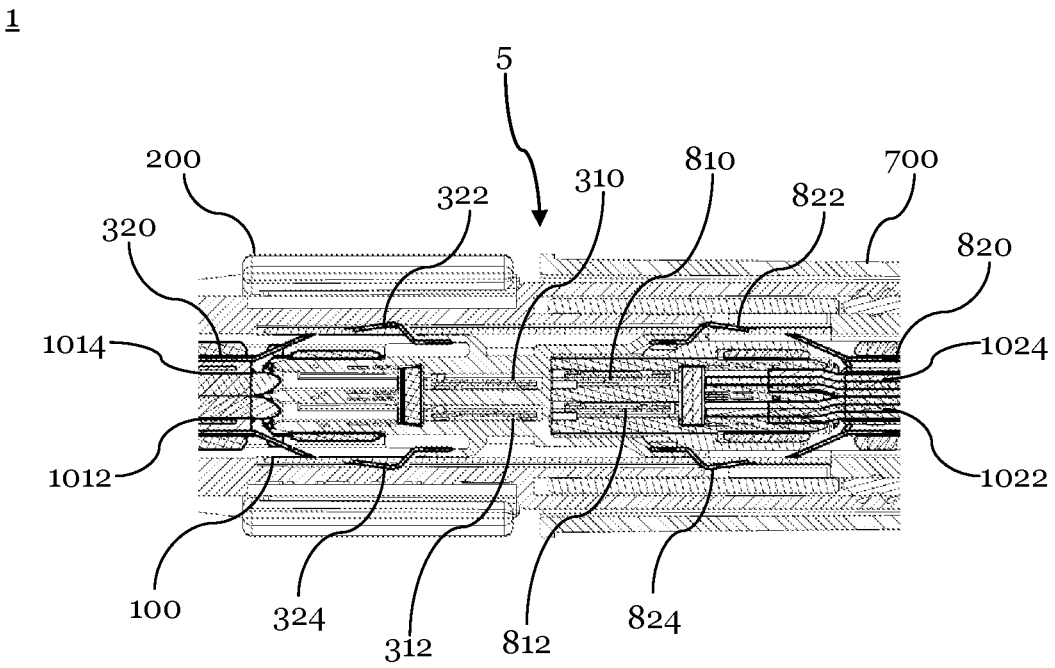
FIG. 8 is a detailed schematic cut view of the electrical connector system of FIG. 6 according to an embodiment of the invention.

FIG. 8 shows a detailed view of the mating region 5 of the electrical connector system 1 in a cut view. The electrical contact pins 310, 312 of the female connector module 300 mate in this region with the electrical contact terminals 810, 812 of the female connector module 800. Further, the female collector connector module 800 is provided with an electrical shielding member 820 that comprises contact beams 822, 824. Similarly, the male connector module 300 is provided with an electrical shielding member 320 that comprises contact beams 322, 324. When the electrical shielding member 100 receives male and female connector modules 300, 800, the contact beams 322, 324, 822, 824 of the shielding members 320, 820 come into electrical contact with the electrical shielding member 100 thereby providing a continuous shielding. In particular, the entire mating region 5 is provided with a four-sided shielding, thereby improving the shielding efficiency of the electrical connector system 1.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical shielding member, comprising:

a receiving portion configured to at least partially receive a connector module and a corresponding connector module so as to surround a mating region of the connector module and/or corresponding connector module on at least four sides when the electrical connector assembly is mated with a second electrical connector assembly, wherein the locking element is a locking lance that protrudes inwardly into the receiving portion and has a free end that is oriented towards a receiving opening of the electrical connector assembly, when the electrical shielding member is in an assembled state.

2. The electrical shielding member in accordance with claim 1, further comprising:

a primary guiding element that protrudes inwardly into the receiving portion and is configured to guide and to support the connector module when the respective connector module is received within the receiving portion.

3. The electrical shielding member in accordance with claim 1, further comprising:

a locking element that is configured to lock with a corresponding locking element of the collector housing when the electrical shielding member is in an assembled state.

4. The electrical shielding member in accordance with claim 1, wherein the receiving portion has a substantially rectangular cross-section as viewed from a mating direction.

5. The electrical shielding member in accordance with claim 1, further comprising:

a secondary guiding element that protrudes inwardly into the receiving portion, wherein the secondary guiding element is configured to guide and to support the connector module and/or a corresponding connector module, when the respective connector module is received within the receiving portion, wherein the primary guiding element protrudes from a first side inwardly into the receiving portion and wherein the at least one secondary guiding element protrudes from an opposing side inwardly into the receiving portion, and wherein the primary guiding element and/or the secondary guiding element is formed as an embossed element.

6. The electrical shielding member in accordance with claim 1, further comprising:

a first coupling element that protrudes outwardly from the receiving portion, and wherein the first coupling element is configured to couple with a corresponding coupling element of a collector housing, when the electrical shielding member is in an assembled state, so as to allow the electrical shielding member to be assembled only under a predefined orientation.

7. The electrical shielding member in accordance with claim 1, further comprising:

a second coupling element that is arranged in proximity to a front end of the receiving portion, wherein the front-end faces towards a receiving opening of the electrical connector assembly, when the electrical shielding member is in an assembled state, and wherein the second coupling element is configured to couple with a corresponding coupling element of a second collector housing, when the electrical shielding member is in an assembled state and when the electrical connector assembly is mated with a second electrical connector assembly.

8. The electrical shielding member in accordance with claim 1, wherein the receiving portion comprises opposing joint rims, wherein a first joint rim is provided with a locking contour and the second joint rim is provided with a corresponding locking contour, and wherein the locking contour engages with the corresponding locking contour, when the electrical shielding member is bent to its final shape.

9. An electrical connector assembly, comprising:

an electrical shielding member in accordance with claim 1;

a connector module, wherein the connector module comprises electrical contact pins and/or electrical contact terminals, and a collector housing, wherein the collector housing houses the connector module and is configured to receive a corresponding connector module at least partially, when the electrical connector assembly is mated with a second electrical connector assembly that comprises the corresponding connector module.

10. An electrical connector assembly, comprising:

an electrical shielding member comprising a receiving portion configured to at least partially receive a connector module and a corresponding connector module so as to surround a mating region of the connector module and/or corresponding connector module on at least four sides when the electrical connector assembly is mated with a second electrical connector assembly;

a connector module, wherein the connector module comprises electrical contact pins and/or electrical contact terminals, and a collector housing, wherein the collector housing houses the connector module and is configured to receive a corresponding connector module at least partially, when the electrical connector assembly is mated with a second electrical connector assembly that comprises the corresponding connector module, wherein the collector housing comprises a corresponding locking element, that locks with the locking element of the electrical shielding member and secures the electrical shielding member within the collector housing, wherein the electrical shielding member is arranged within the collector housing to be in electrical contact with a shielding of the connector module and a shielding of the corresponding connector module, when the electrical connector assembly is mated with a second electrical connector assembly, and wherein the collector housing further comprises a corresponding coupling element that couples with the coupling element of the electrical shielding member and secures the electrical shielding member in a predefined orientation, and wherein the collector housing is a one-piece collector housing.

11. The electrical connector assembly in accordance with claim 9, wherein electrical shielding member is arranged within the collector housing so that it surrounds a mating region of the connector module and a corresponding connector module on at least four sides, when the electrical connector assembly is mated with a second electrical connector assembly.

12. The electrical connector assembly in accordance with claim 9, wherein the electrical shielding member and the connector module, are arranged within the collector housing so that during mating the electrical connector assembly with a second electrical connector assembly, the electrical shielding member comes into electrical contact with the shielding of the corresponding connector module, before the electrical contact pins and/or terminals of the connector module come into electrical contact with the corresponding electrical contact terminals and/or pins of the corresponding connector module.

13. An electrical connector system, comprising an electrical connector assembly in accordance with claim 9, and a second electrical connector assembly, that is configured to be mated with the electrical connector assembly, wherein the second electrical connector assembly comprises:

a corresponding connector module that includes electrical contact terminals and/or electrical contact pins, a shielding, and a second collector housing, that includes a corresponding coupling element that is configured to couple with the electrical shielding member, when the electrical connector assembly is mated with the second electrical connector assembly.

14. A method to assemble an electrical connector assembly, comprising the steps of:

providing an electrical shielding member which includes a receiving portion configured to at least partially receive a connector module and a corresponding connector module so as to surround a mating region of the connector module and/or corresponding connector module on at least four sides when the electrical connector assembly is mated with a second electrical connector assembly, wherein the locking element is a locking lance that protrudes inwardly into the receiving portion and has a free end that is oriented towards a receiving opening of the electrical connector assembly, when the electrical shielding member is in an assembled state;

providing a collector housing;

providing a connector module;

assembling the electrical shielding member and the collector housing and locking the locking element of the electrical shielding member with the corresponding locking element of the collector housing, and inserting a connector module at least partially into the receiving portion of the electrical shielding member, so that the electrical shielding member surrounds the mating region of the connector module on at least four sides.

15. The electrical shielding member in accordance with claim 1, further comprising:

a primary guiding element that protrudes inwardly into the receiving portion and is configured to guide and to support a corresponding connector module when the respective connector module is received within the receiving portion.

16. The electrical shielding member in accordance with claim 1, further comprising:

a primary guiding element that protrudes inwardly into the receiving portion and is configured to guide and to support the connector module and a corresponding connector module when the respective connector module is received within the receiving portion.

* * * * *